US008272693B2

(12) United States Patent
Hall et al.

(10) Patent No.: US 8,272,693 B2
(45) Date of Patent: Sep. 25, 2012

(54) TENSION MECHANISM FOR A WEIGHT-RESPONSIVE CHAIR

(75) Inventors: Jason Hall, Holland, MI (US); Stephen J. Simpson, Grand Rapids, MI (US); Simon DeSanta, Borgholzhausen (DE)

(73) Assignee: Haworth, Inc., Holland, MI (US)

( * ) Notice: Subject to any disclaimer, the term of this patent is extended or adjusted under 35 U.S.C. 154(b) by 0 days.

(21) Appl. No.: 12/925,889

(22) Filed: Nov. 1, 2010

(65) Prior Publication Data

US 2012/0062006 A1 Mar. 15, 2012

Related U.S. Application Data

(63) Continuation of application No. PCT/US2009/002729, filed on May 1, 2009.

(60) Provisional application No. 61/126,309, filed on May 2, 2008.

(51) Int. Cl.
*A47C 1/024* (2006.01)

(52) U.S. Cl. ..... 297/300.4; 297/296

(58) Field of Classification Search ..... 297/285, 297/291, 292, 296, 300.1, 300.2, 300.5, 338, 297/339, 452.18
See application file for complete search history.

(56) References Cited

U.S. PATENT DOCUMENTS

| | | | |
|---|---|---|---|
| 280,356 | A | 7/1883 | Curtiss |
| 332,237 | A | 12/1885 | Curtiss |
| 337,260 | A | 3/1886 | Hanlon |
| 376,886 | A | 1/1888 | Holden |
| 630,381 | A | 8/1899 | Mann |
| 666,110 | A | 1/1901 | Paine |
| 740,825 | A | 10/1903 | Dorney |
| 744,176 | A | 11/1903 | Del Mar |
| 868,052 | A | 10/1907 | Wilmot |
| 878,889 | A | 2/1908 | Miller |
| 1,515,564 | A | 11/1924 | Field |
| 2,251,318 | A | 8/1941 | Blair et al. |
| 2,843,195 | A | 7/1958 | Barvaeus |
| 3,288,525 | A | 11/1966 | Cerf |
| 3,669,497 | A | 6/1972 | Massonnet |

(Continued)

FOREIGN PATENT DOCUMENTS

| | | |
|---|---|---|
| CA | 2 087 981 | 11/1992 |

(Continued)

OTHER PUBLICATIONS

International Preliminary Report on Patentability (Form PCT/IB/373) Application No. PCT/US2009/002729 dated Nov. 2, 2010 (1 page).

(Continued)

*Primary Examiner* — Sarah B McPartlin
(74) *Attorney, Agent, or Firm* — Flynn, Thiel, Boutell & Tanis, P.C.

(57) ABSTRACT

A weight-responsive chair is provided which has a weight-activated mechanism that resists rearward tilting of a chair back upright while also effecting lifting of a rear portion of the seat to counteract the rearward tilt forces. The weight-activated mechanism includes a spring package connected between the chair frame and back upright which provides for ready mounting of same to the chair frame. Further, the rear seat portion is connected in lifting engagement with the upright but also includes independent suspension for the center of the rear seat portion to allow for independent movement and flexing thereof to improve comfort for the chair occupant.

20 Claims, 14 Drawing Sheets

U.S. PATENT DOCUMENTS

| | | | | |
|---|---|---|---|---|
| 3,758,159 | A | 9/1973 | Morris | |
| 3,833,260 | A | 9/1974 | Harder, Jr. | |
| 4,032,190 | A | 6/1977 | Muller Deisig et al. | |
| 4,077,669 | A | 3/1978 | Fox | |
| 4,189,880 | A | 2/1980 | Ballin | |
| 4,333,683 | A | 6/1982 | Ambasz | |
| 4,364,607 | A | 12/1982 | Tamburini | |
| 4,411,469 | A | 10/1983 | Drabert et al. | |
| 4,418,958 | A | 12/1983 | Watkin | |
| 4,469,738 | A | 9/1984 | Himelreich, Jr. | |
| 4,469,739 | A | 9/1984 | Gretzinger et al. | |
| 4,478,454 | A | 10/1984 | Faiks | |
| 4,479,679 | A | 10/1984 | Fries et al. | |
| 4,652,050 | A | 3/1987 | Stevens | |
| 4,660,887 | A | 4/1987 | Fleming et al. | |
| 4,709,962 | A | 12/1987 | Steinmann | |
| 4,733,910 | A | 3/1988 | Brennan | |
| 4,744,603 | A | 5/1988 | Knoblock | |
| 4,765,679 | A | 8/1988 | Lanuzzi et al. | |
| 4,796,952 | A | 1/1989 | Piretti | |
| 4,834,454 | A | 5/1989 | Dicks | |
| 4,856,845 | A | 8/1989 | Massonnet | |
| 4,856,846 | A | 8/1989 | Lohmeyer | |
| 869,554 | A | 9/1989 | Abu-Isa et al. | |
| 4,869,554 | A | 9/1989 | Abu-Isa et al. | |
| 4,890,883 | A | 1/1990 | Boerema et al. | |
| 4,892,356 | A | 1/1990 | Pittman et al. | |
| 4,900,085 | A | 2/1990 | Tobler | |
| 4,953,913 | A * | 9/1990 | Graebe | 297/452.25 |
| 4,962,962 | A | 10/1990 | Machate et al. | |
| 4,962,964 | A | 10/1990 | Snodgrass | |
| 5,013,089 | A | 5/1991 | Abu-Isa et al. | |
| 5,013,098 | A | 5/1991 | Mergenthaler | |
| 5,116,556 | A | 5/1992 | Danton | |
| 5,121,963 | A | 6/1992 | Kwasnik et al. | |
| 5,224,758 | A | 7/1993 | Takamatsu et al. | |
| RE34,333 | E | 8/1993 | Boerema et al. | |
| 5,318,345 | A | 6/1994 | Olson | |
| 5,333,934 | A | 8/1994 | Knoblock | |
| 5,468,035 | A | 11/1995 | Fountain | |
| 5,487,591 | A | 1/1996 | Knoblock | |
| 5,503,454 | A | 4/1996 | Sakamoto | |
| 5,533,789 | A | 7/1996 | McLarty, III et al. | |
| 5,599,608 | A | 2/1997 | Yamamoto et al. | |
| 5,632,526 | A | 5/1997 | McLarty, III et al. | |
| 5,704,691 | A | 1/1998 | Olson | |
| 5,725,276 | A | 3/1998 | Ginat | |
| 5,765,804 | A | 6/1998 | Stumpf et al. | |
| 5,806,930 | A | 9/1998 | Knoblock | |
| 5,807,794 | A | 9/1998 | Knox et al. | |
| 5,931,531 | A | 8/1999 | Assmann | |
| 5,934,758 | A | 8/1999 | Ritch et al. | |
| 5,975,634 | A | 11/1999 | Knoblock et al. | |
| 6,109,694 | A | 8/2000 | Kurtz | |
| 6,214,266 | B1 | 4/2001 | Millif et al. | |
| 6,226,819 | B1 | 5/2001 | Ogawa et al. | |
| 6,234,573 | B1 | 5/2001 | Röder et al. | |
| 6,245,264 | B1 | 6/2001 | Krause et al. | |
| D453,633 | S | 2/2002 | Diffrient | |
| 6,403,195 | B1 | 6/2002 | Montagna et al. | |
| 6,409,268 | B1 | 6/2002 | Cvek | |
| 6,588,844 | B1 * | 7/2003 | Stenzel | 297/300.2 |
| 6,626,497 | B2 | 9/2003 | Nagamitsu et al. | |
| 6,669,301 | B1 | 12/2003 | Funk et al. | |
| 6,698,833 | B2 | 3/2004 | Ball et al. | |
| 6,709,058 | B1 | 3/2004 | Diffrient | |
| 6,729,691 | B2 | 5/2004 | Koepke et al. | |
| 6,820,934 | B2 * | 11/2004 | Ware et al. | 297/285 |
| 6,849,227 | B2 | 2/2005 | Funk et al. | |
| 6,880,215 | B2 | 4/2005 | Peterson | |
| 6,880,886 | B2 | 4/2005 | Bodnar et al. | |
| 6,886,888 | B2 | 5/2005 | Bock | |
| 6,908,159 | B2 | 6/2005 | Prince et al. | |
| 6,932,430 | B2 | 8/2005 | Bedford et al. | |
| 6,942,300 | B2 | 9/2005 | Numa et al. | |
| 7,014,269 | B2 | 3/2006 | Coffield et al. | |
| 7,032,971 | B2 | 4/2006 | Williams | |
| 7,040,709 | B2 | 5/2006 | Knoblock et al. | |
| 7,090,296 | B2 | 8/2006 | Massimo | |
| 7,118,177 | B2 | 10/2006 | Piretti | |
| 7,131,700 | B2 | 11/2006 | Knoblock et al. | |
| 7,159,943 | B2 | 1/2007 | Costaglia | |
| D546,574 | S | 7/2007 | Kaloustian | |
| D584,908 | S | 1/2009 | Diffrient | |
| 7,866,750 | B2 | 1/2011 | Bock | |
| 2003/0047982 | A1 | 3/2003 | Ball et al. | |
| 2004/0174062 | A1 | 9/2004 | Huse | |
| 2005/0264071 | A1 | 12/2005 | Costaglia | |
| 2006/0103222 | A1 | 5/2006 | Stumpf et al. | |
| 2006/0154027 | A1 | 7/2006 | Dry | |
| 2006/0170263 | A1 | 8/2006 | Heidmann | |
| 2006/0170274 | A1 | 8/2006 | Moule | |
| 2006/0273634 | A1 | 12/2006 | Kaloustian et al. | |
| 2007/0001497 | A1 | 1/2007 | Diffrient | |
| 2007/0126138 | A1 | 6/2007 | Dooley et al. | |
| 2008/0136239 | A1 | 6/2008 | Bock | |
| 2008/0217977 | A1 * | 9/2008 | Aldrich et al. | 297/284.3 |
| 2008/0272638 | A1 | 11/2008 | Bock | |

FOREIGN PATENT DOCUMENTS

| | | | |
|---|---|---|---|
| DE | 85 34 420 | U1 | 2/1986 |
| DE | 36 05 809 | | 8/1987 |
| DE | 198 10 768 | A1 | 9/1999 |
| DE | 199 22 446 | A1 | 11/2000 |
| DE | 101 47 548 | C1 | 11/2002 |
| DE | 20 2006 000 491 | U1 | 4/2006 |
| DE | 10 2005 020 237 | B3 | 8/2006 |
| DE | 10 2005 029 906 | B3 | 1/2007 |
| EP | 0 249 584 | A2 | 12/1987 |
| EP | 0 277 474 | A1 | 8/1988 |
| EP | 0 591 932 | A1 | 4/1994 |
| EP | 1 491 117 | B1 | 12/2004 |
| FR | 2 683 842 | A1 | 5/1993 |
| WO | WO 92/20262 | | 11/1992 |
| WO | WO 00/74531 | A2 | 12/2000 |
| WO | WO 2006/114239 | A1 | 11/2006 |
| WO | WO 2007/000270 | A1 | 1/2007 |
| WO | WO 2007/012418 | A1 | 2/2007 |

OTHER PUBLICATIONS

Written Opinion of the International Searching Authority (Form PCT/ISA/237) Application No. PCT/US2009/002729 (5 pages).

International Search Report (Form PCT/ISA/210) Application No. PCT/US2009/002729 dated Oct. 2, 2009 (5 pages).

* cited by examiner

TENSION MECHANISM FOR A WEIGHT-RESPONSIVE CHAIR

CROSS REFERENCE TO RELATED APPLICATIONS

This application is a continuation of International Application No. PCT/US2009/002729, filed May 1, 2009, which claims the benefit of U.S. Provisional Application Ser. No. 61/126,309, filed May 2, 2008, which is incorporated by reference herein in its entirety.

FIELD OF THE INVENTION

The invention relates to a weight-responsive office chair, and more particularly, to an office chair having an improved weight-activated mechanism for controlling rearward and downward tilting of a seat and back of the chair.

BACKGROUND OF THE INVENTION

Weight-responsive chair mechanisms are used to control tilting of a seat and back assembly for the chair. In some chair constructions, the entire rearward tilting force of a seat-back assembly is controlled by a tilt control mechanism and the springs thereof which resist the entire load generated by the seat and back assembly. This load is basically generated by the body weight of the chair occupant and their movements rearwardly wherein the spring capacity of the tilt control mechanism must accommodate all of this load.

In a weight-responsive mechanism, the back is connected to a rear portion of the seat such that rearward tilting of the back essentially effects lifting of the rear of the seat wherein the weight of the occupant on the seat opposes such lifting, and therefore, serves to counterbalance much of the tilting forces being applied directly to the back. These tilting forces applied to the back are transferred to the rear of the seat by an intermediate link so that the weight of the occupant is used to resist the rearward tilt forces. While a tilt mechanism having a spring is provided, the spring capacity of this mechanism is substantially lower due to the assistance provided by the occupant's body weight in resisting tilting of the back assembly. One of the primary functions of the spring mechanism is to return the seat and back assembly to a normal upright condition when the occupant discontinues attempts to tilt the back rearwardly or when the occupant stands up from the chair.

It is an object of the invention to provide an improved weight-activated mechanism for a weight-responsive chair which provides an improved construction relative to prior art chairs of this type.

The weight-responsive chair of the invention has a back upright pivotally connected to a chair frame with a connector link that extends forwardly from the pivot point of the back and connects to a rear portion of the seat. The seat also is pivotally connected to the chair frame at the front thereof by a front pivot link wherein the combination of the front link, the chair frame, the seat and the connector link of the back upright define a four-bar linkage wherein rearward tilting of the back upright effects lifting of the rear portion of the seat. Also, the four-bar linkage preferably effects lifting of the front portion of the seat by the front link.

The improved chair of the invention further includes a tension mechanism connected between the chair frame and the rear upright to provide a relatively low level of resistance to tilting of the back upright. The tension mechanism includes a spring or biasing arrangement which serves to restore the seat and back to an upright position. The back, however, has a forwardly extending connector link projecting from the pivot mount by which the back is pivotally connected to the chair frame. This connector link is connected at its forward end to the rear portion of the seat so that rearward tilting of the upright causes the connector link to pivot upwardly and thereby lift the seat against the weight of the user. The counteracting weight of the user acting downwardly on the connector link serves to resist tilting of the interconnected back so that much of the resistance to tilting results from the weight of the user so that the chair mechanism is weight responsive.

Additionally, the seat of this chair uses a seat support frame connected to a seat panel which is pivoted at its front end to the main chair frame and at the back end to the tension mechanism. Additionally, the seat frame includes resiliently deflectable frame extensions or suspension arms which interconnect to the central portion of the rear of the seat, which cantilevered extensions allow for resilient vertical displacement of the rear portion of the seat relative to the weight-responsive mechanism. Hence, the weight-responsive mechanism does effect lifting of the rear portion of the seat while the frame extensions also permit independent resilient movement of the rear seat portion to improve comfort to the chair occupant.

Other objects and purposes of the invention, and variations thereof, will be apparent upon reading the following specification and inspecting the accompanying drawings.

Figure 1:
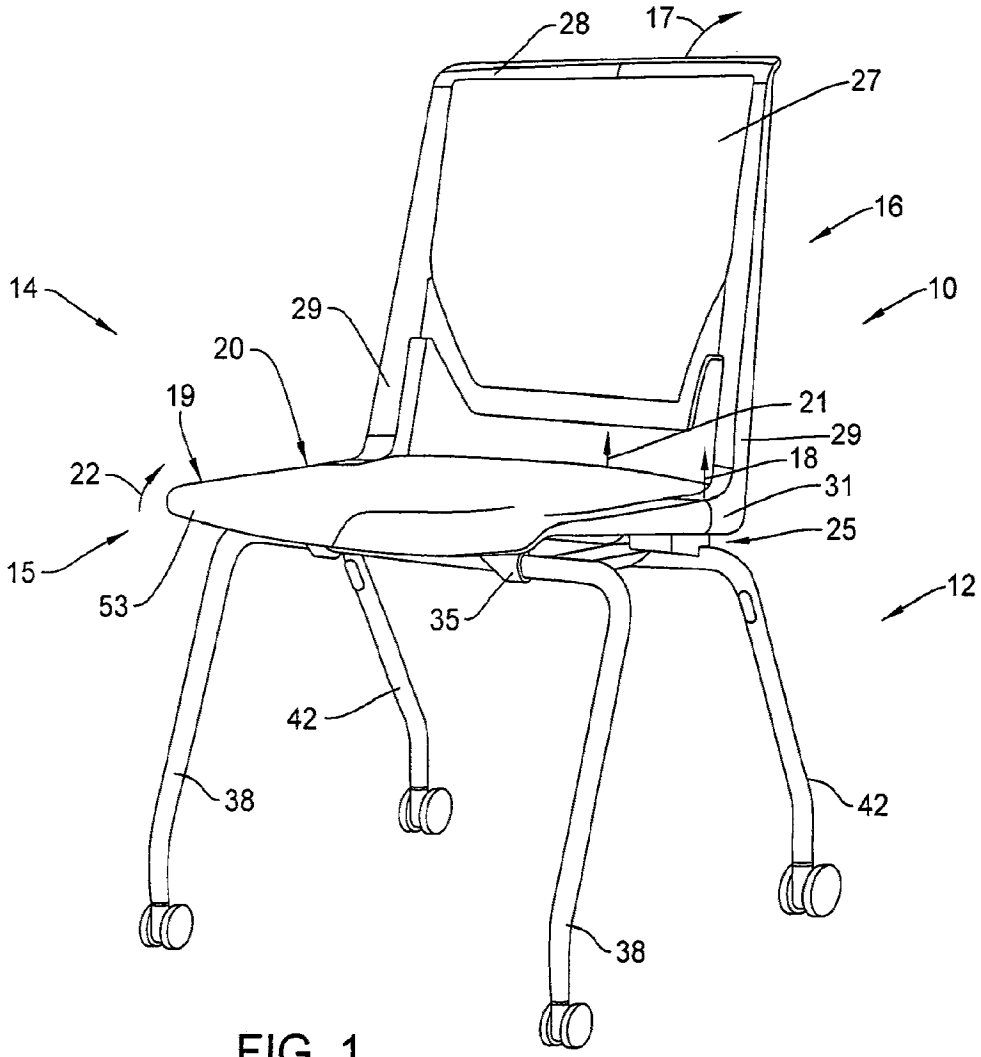
FIG. 1 is a front perspective view of a chair embodying the invention.

Certain terminology will be used in the following description for convenience and reference only, and will not be limiting. For example, the words "upwardly", "downwardly", "rightwardly" and "leftwardly" will refer to directions in the drawings to which reference is made. The words "inwardly" and "outwardly" will refer to directions toward and away from, respectively, the geometric center of the arrangement and designated parts thereof. Said terminology will include the words specifically mentioned, derivatives thereof, and words of similar import.

DETAILED DESCRIPTION

Referring to FIGS. 1-4, the chair 10 of the invention is a weight-responsive type office chair wherein the weight of the chair occupant resists rearward tilting thereof having a weight-activated mechanism controlling rearward tilting or recline of the chair 10.

Generally, the chair comprises a main chair frame or base 12 which supports a seat-back assembly 14 thereon. The seat-back assembly 14 comprises a seat assembly 15 and a back assembly 16. The back assembly 16 is pivotally supported on the chair frame 12 to permit rearward tilting of the back assembly in the direction of reference arrow 17. This tilting causes a forwardly extending portion located at the bottom of the back assembly 16 to pivot upwardly as indicated by reference arrow 18.

The seat assembly 15 has a front portion 19 which is pivotally connected to the main frame 12 and has a rear seat portion 20 which is pivotally connected to the back frame 16. During rearward tilting of the back assembly 16, the interconnection with the rear seat portion 20 causes the seat to displace generally upwardly as indicated by reference arrow 21 which is in the same upward direction as reference arrow 18 which in turn causes the front seat portion 19 to displace rearwardly and upwardly as indicated by reference arrow 22.

As such, rearward displacement of the back assembly 16 in the direction of arrow 17 by a chair occupant also causes lifting of the rear seat portion 20 which thereby acts against the weight of the chair occupant. Hence, while the chair occupant will be pushing rearwardly on the back assembly 16, the weight of the chair occupant acting downwardly on the rear seat portion 20 also resists this rearward displacement of the back assembly to thereby balance some of the rearwardly directed loads generated by the occupant. The back assembly 16 is still able to pivot rearwardly but responds to the weight of the chair occupant so that tilting of the seat-back assembly 14 is conducted smoothly and does not require a significant amount of additional tilt resistance such as might be generated by additional spring packages in the chair.

For a non-weight responsive type chair, a spring package is required which essentially has a spring capacity that is able to substantially counterbalance almost all of the rearwardly directed loads generated by the chair occupant, wherein the weight of the occupant typically has little if any effect in resisting tilting.

In the weight-responsive type chair 10 of the invention, most of the tilting forces are counterbalanced by the occupant's weight. The inventive office chair 10 does include a pair of tension mechanisms 25 in the rear corners of the chair which cooperate between the back assembly 16 and the frame 12 to generate a restoring force acting on the back assembly that tends to act against rearward tilting thereof. The restoring forces generated by the tension mechanisms 25 act against rearward tilting and, to a relatively low extent, act against the chair occupant when the occupant is attempting to tilt a chair. However, the primary intent and function of the tension mechanisms 25 is to generate restoring forces which act to move the back assembly 16 to the normal upright condition illustrated in FIG. 2, such as when a chair occupant leans forwardly or even stands up from the chair. Due to the weight responsiveness of the interconnection between the seat assembly 15 and back assembly 16, the spring loads or restoring forces generated by the tension mechanisms 25 can be kept relatively low so as to serve the primary function of maintaining the back assembly 16 in the upright condition in a normal unloaded or unoccupied condition.

The invention therefore relates to the improved construction of the tension mechanisms 25 as well as improvements in the seat assembly 15 as disclosed in further detail hereinafter.

Figure 5:
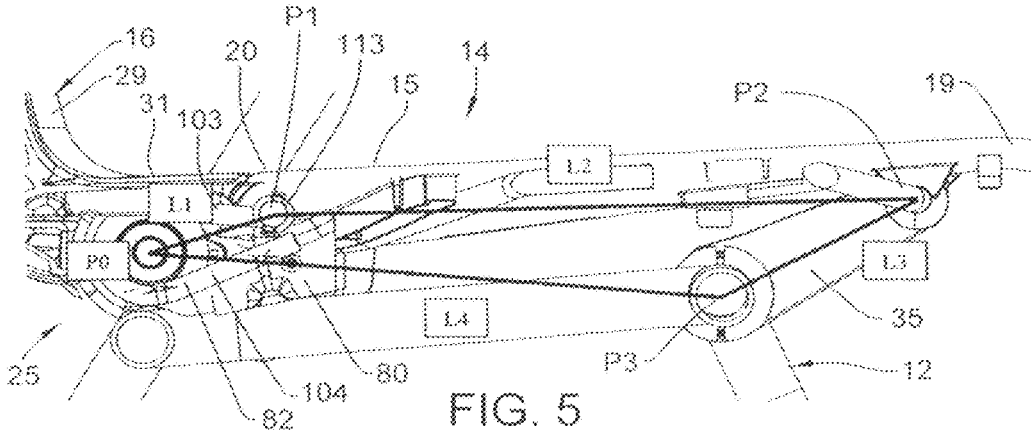
FIG. 5 is a side view of the chair linkage.

Referring to FIG. 5, the chair components generally define a four-bar linkage which controls tilting of the seat assembly 15 as well as movement of the back assembly 16. The back assembly 16 is pivotally connected to the chair frame 12 by the tension mechanism 25 such that the general movement defined by the four-bar linkage controls the pivoting movement of the back assembly 16 as will be described in further detail herein.

Referring first to FIGS. 1-4, the back assembly 16 comprises a main back section 27 which has a panel-like configuration that is supported on an integral back frame 28 that extends about the periphery of the panel-like back section 27. The back frame 28 includes a pair of upright members 29 which project downwardly for pivotal engagement with the tension mechanism 25.

Figure 2:
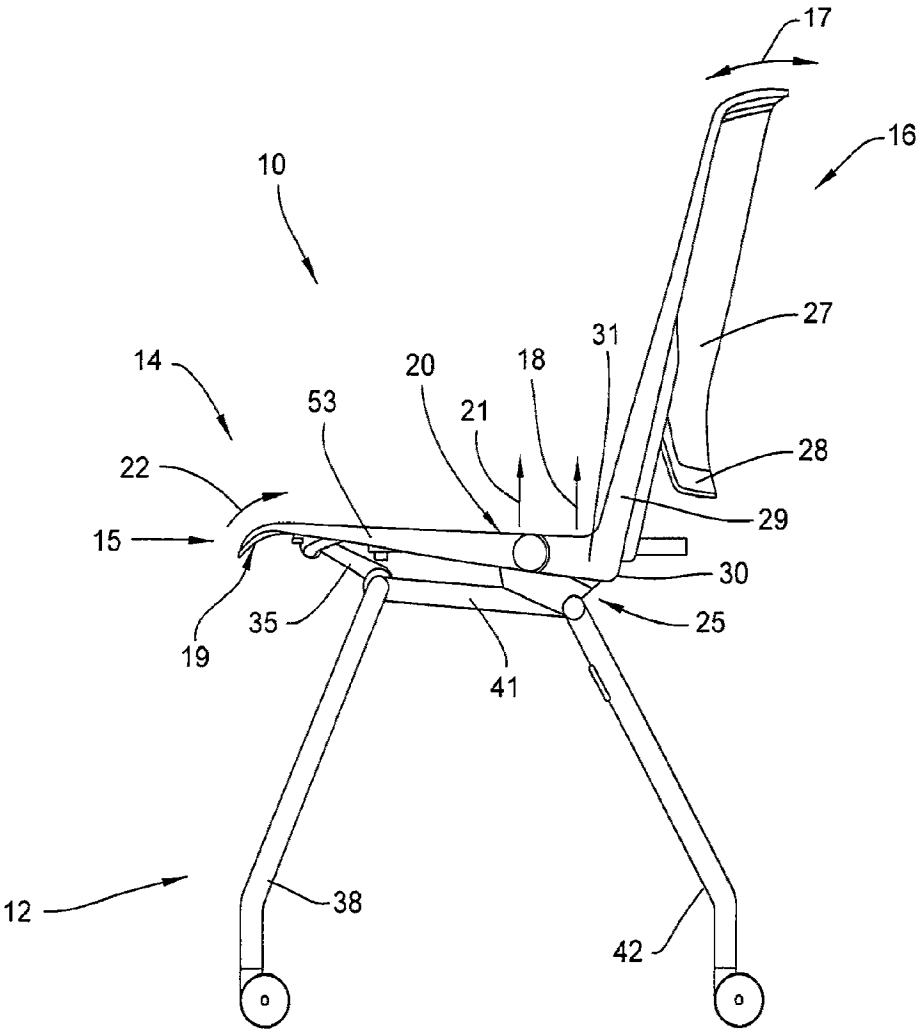
FIG. 2 is a side elevational view thereof.
Figure 3:
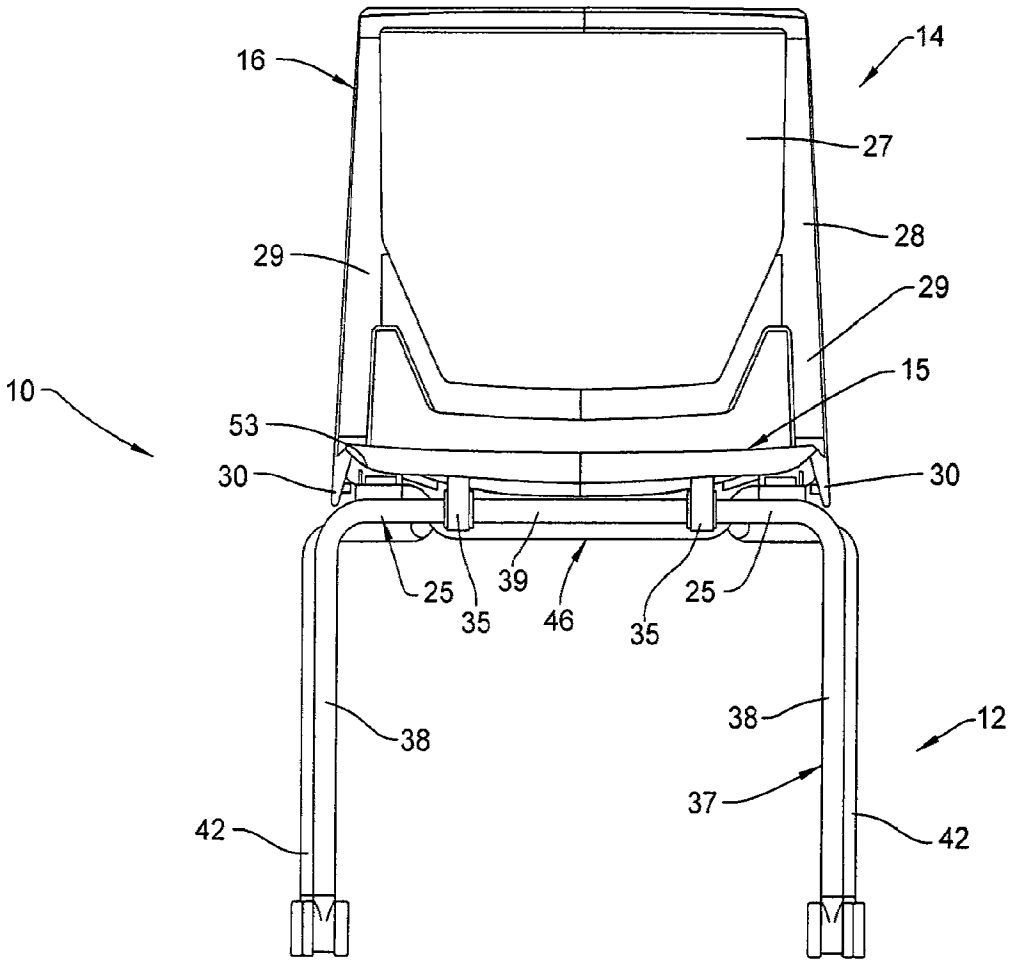
FIG. 3 is a front view thereof.
Figure 4:
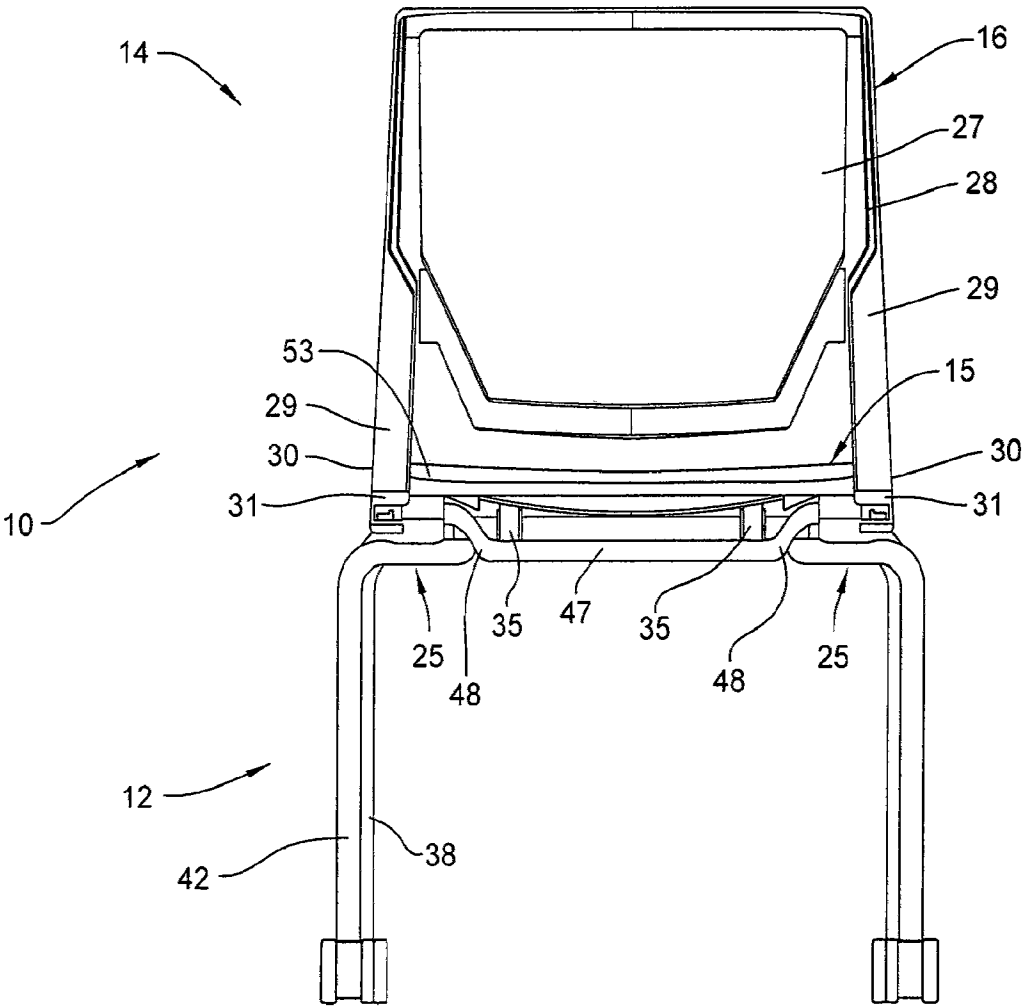
FIG. 4 is a rear view thereof.

As seen in the views of FIG. 3, these upright members 29 project downwardly and are sidewardly separated. Hence, the back assembly 16 connects to the chair frame 12 at two locations, namely at the locations of the two upright members 29. As seen in the side view of FIG. 2, each upright member 29 extends downwardly and then has an L-shaped end section 30 that projects forwardly to define a mounting leg 31. This mounting leg 31 is connected to the tension mechanism 25 as described below, which tension mechanism 25 defines the pivot point about which the upright members 29 pivot rearwardly in the direction of reference arrow 17.

Figure 6:
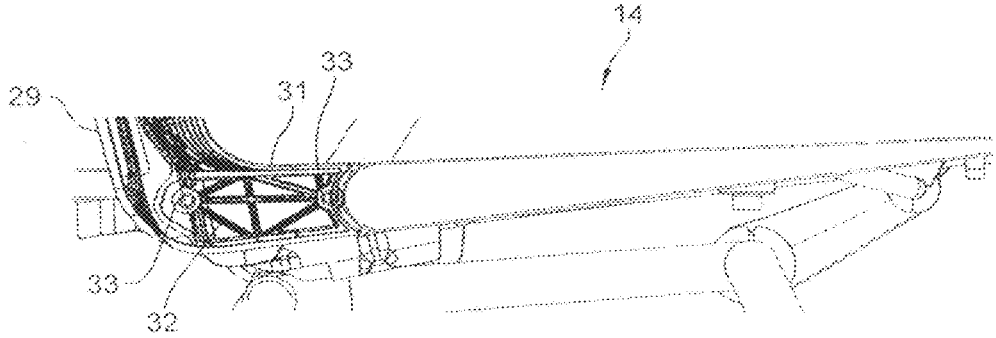
FIG. 6 is a side view of the chair showing interior details of the back upright.
Figure 7:
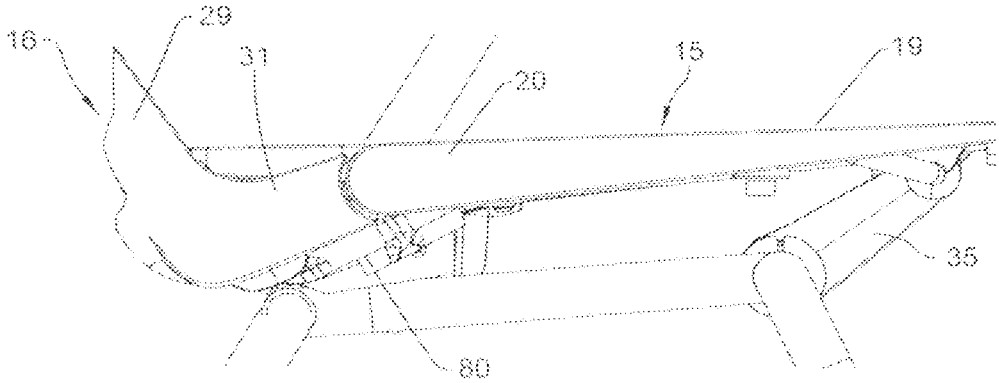
FIG. 7 is an exterior side view of the chair linkage in a rearwardly tilted orientation.

Referring to FIGS. 5-7, the upright member 29 is shown in the normal, upright position, while FIG. 7 illustrates the upright member 29 after rearward tilting of the back assembly 16. FIG. 6 is prepared so as to illustrate interior details of the mounting leg 31. In particular, the upright member 29 and its mounting leg 31 are formed of a rigidly molded construction having strengthening ribs 32 on the outwardly facing portion thereof. The strengthening ribs 32 furthermore support a pair of fastener bores 33 which allow for fastening of the upright members 29 to the respective tension mechanisms 25.

As to the linkage defined in the chair, the tension mechanism is shown in FIG. 5 and has its respective upright member 29 fixedly connected thereto. The tension mechanism 25 and its connection to the chair frame 12 essentially defines the pivot axis P0 about which the upright member 29 pivots. The tension mechanism 25 further has the seat assembly 15 pivotally connected thereto to thereby define the second pivot point P1 which is the pivot location at which the rear seat portion 20 is connected. As a result, the tension mechanism 25 defines a first link L1 of the four-bar linkage.

The seat assembly 15 extends generally horizontally forward and defines a second link L2, while the chair frame essentially defines the fourth linkage L4 that is stationary. For the third linkage, a pair of front links 35 are provided which are pivotally connected at the upper end thereof to the seat assembly 15 to define the next pivot point P2. The lower end of each pivot link 35 is pivotally connected to the chair frame 12 to define a fourth pivot point P3. FIG. 6 generally illustrates the seat-back assembly 14 in a normal upright position corresponding to the orientation of the four-bar linkage shown in FIG. 5.

However, upon rearward tilting of the back assembly 16, the link L1 pivots upwardly and rearwardly which thereby causes lifting and rearward displacement of the rear portion 20 of the seat assembly 15 which causes a corresponding rearward displacement of the front seat portion 19. Movement of the front seat portion 19 is governed by the front links 35 which pivot rearwardly and upwardly to also cause a corresponding lifting and rearward movement of the front seat portion 19 as the links 35 pivot about the pivot axis P3. However, in this weight-activated mechanism, the weight of the chair occupant still acts downwardly upon the front and rear seat portions 19 and 20 so as to cause a weight-generated force which acts downwardly on pivot location P1 to thereby resist the rearward and upward displacement of link L1 about pivot point P0. Hence, the weight of the occupant, as previously mentioned, actually resists rearward displacement of the back assembly 16, and if the chair occupant is not pushing or attempting to rearwardly recline the back assembly 16, the occupant's weight thereby tends to return the back assembly 16 to a normal upright position or at least move forwardly to a partially reclined position which might be more comfortable to the chair occupant.

As previously indicated, the tension mechanism 25 generates a resilient biasing force which acts on the mounting leg 31 of the upright members 29 to also tend to drive the back assembly 16 forwardly to a normal upright position. The tension mechanism 25 will be described in greater detail hereinafter.

Figure 8:
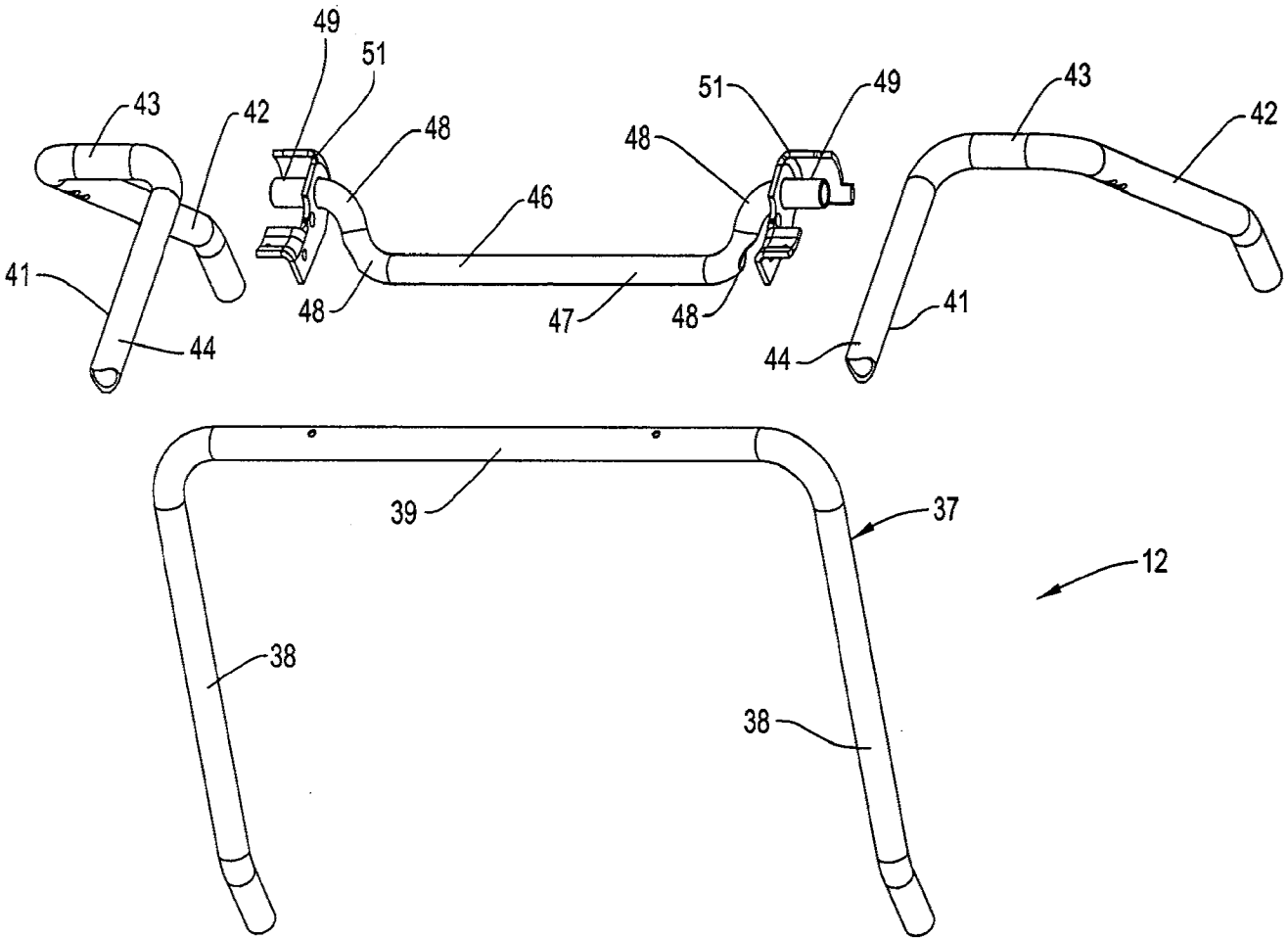
FIG. 8 is an exploded view of the base chair frame.

Turning to the main chair frame 12 as illustrated in FIG. 8, the chair frame 12 preferably is a tubular frame construction in this embodiment although other frame constructions may be provided while still incorporating the inventive concepts therein. The main chair frame 12 comprises a front frame tube 37 which is formed in a U-shape and comprises a pair of vertical front legs 38 which are joined sidewardly or laterally together by horizontal cross tube 39.

This front frame tube 37 has a pair of rearwardly extending side frame tubes 41 which are generally L-shaped and have their front ends fixedly secured such as by welding directly to the front frame tube 37. The side tubes 41 comprise downwardly extending sections that define the rear legs 42, transverse extensions 43 and side extensions 44 which extend forwardly and have the free ends thereof welded to the front frame tube 37.

The chair frame 12 further includes a transverse mounting tube 46 which is defined by a central tube section 47 that has opposite ends 48 directly welded to the interior sides of the side frame extensions 44. The central tube section 47 further has an L-shaped mounting section 48 which generally projects upwardly and then sidewardly above the side frame extensions 44 to define tubular mounting posts 49. These tubular mounting posts 49 project sidewardly and are configured for mounting of respective tension mechanisms 25 thereto.

The chair frame 12 also has a stationary support bracket 51 which is welded directly to the mounting section 48 so as to be permanently affixed thereto, preferably by welding. While the support bracket 51 is permanently affixed to the chair frame 12, it will be understood that the support bracket 51 essentially forms part of the tension mechanism 25 as will be described in further detail hereinafter.

Figure 9:
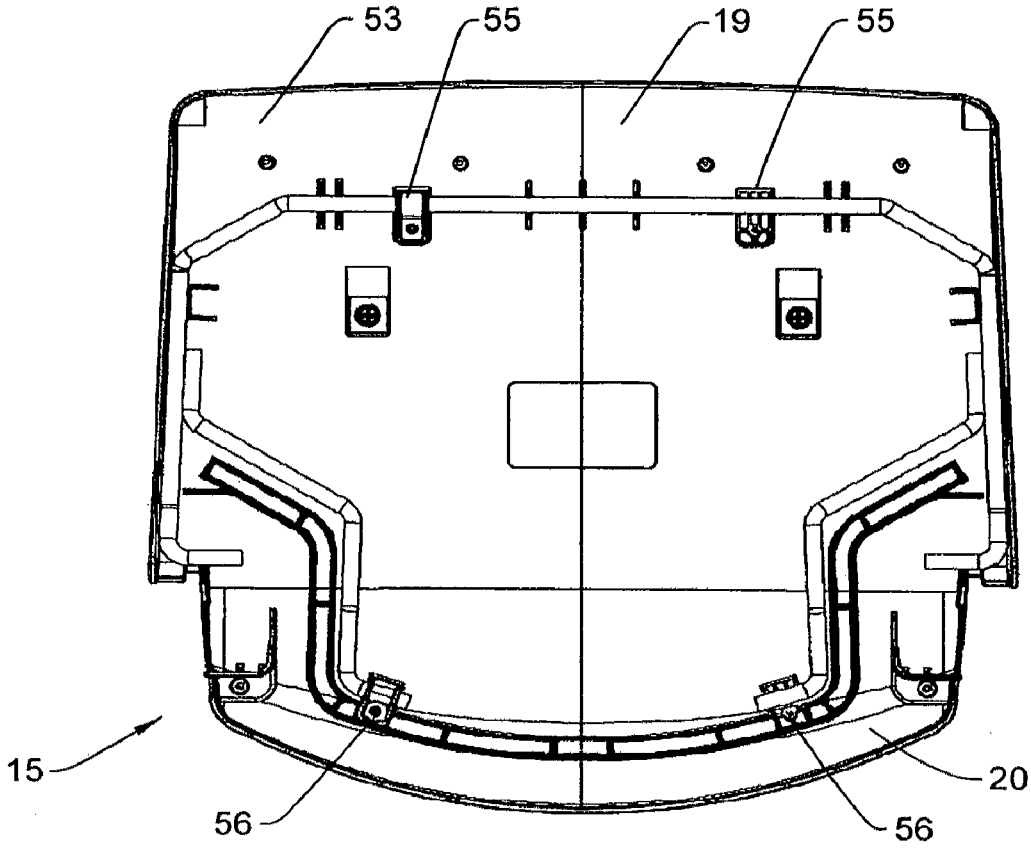
FIG. 9 is a bottom view of the seat assembly with a seat panel and a seat frame mounted together.
Figure 10:
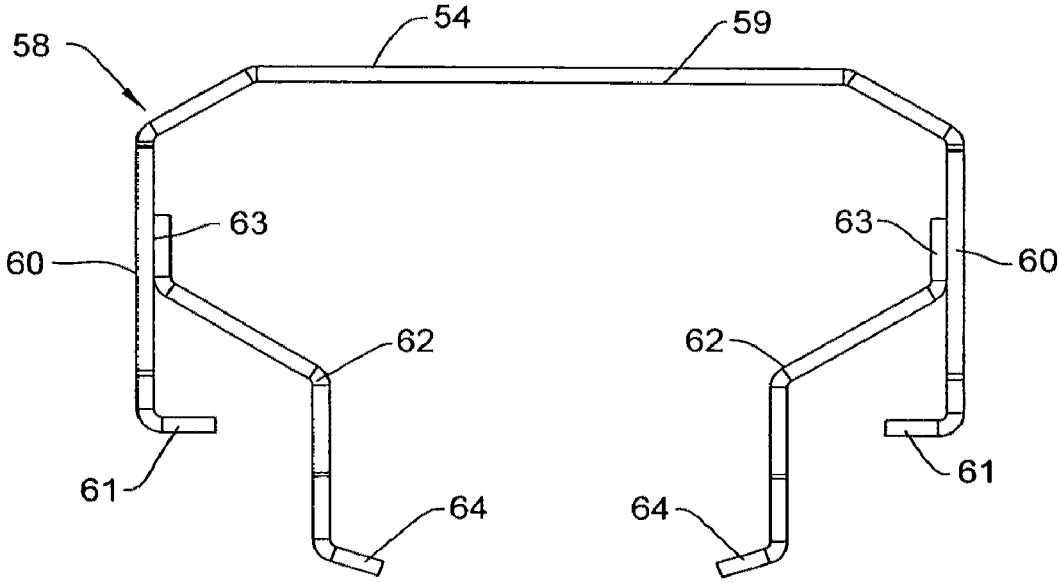
FIG. 10 is a bottom plan view of the seat support frame.

Referring to FIGS. 9 and 10, the seat assembly 15 comprises a plastic molded seat panel 53 to which is mounted a seat frame 54 on the underside thereof. The seat panel 53 of FIG. 9 includes a pair of frame connectors 55 on the front seat portion 19, while the rear seat portion 20 includes a pair of rear seat connectors 56 which serve to mechanically fasten the seat frame 54 to the seat panel 53. As to the seat frame 54, this seat frame 54 is preferably formed from support rods that are joined together and essentially define the horizontal moving member L2 of the four-bar linkage. Further, the seat frame 54 serves to mount the seat panel 53 to the remainder of the chair frame 12.

More particularly as to the seat assembly 15, this assembly 15 provides an improved seat configuration wherein the seat frame 54 first connects the seat panel 53 to the frame 12, while it also allows the rear portion of the seat 12 to have additional support as provided by a resiliently deflectable suspension system.

More particularly, the seat frame 54 of FIG. 10 is formed of a main frame rod 58 formed generally into a U shape by a transverse rod section 59 which turns rearwardly and defines side rod sections 60. The rearmost ends of the side rod sections 60 then turn inwardly to define short, pin-like pivot mounts 61, which pivot mounts 61 are adapted to pivotally connect to the tension mechanisms 25 at pivot point P1 as will be described further herein. Additionally, the improved seat frame 54 also includes a pair of rod-like suspension arms 62 which join at the mid-point of the side rod sections 60 by front rod ends 63 and then turn inwardly and then rearwardly so as to terminate at inwardly turned connecting rod sections 64. As such the suspension arms 62 are joined in cantilevered relation to the main frame rod 58 wherein the arms 62 resiliently flex so that the rearward free ends defined at the connecting rod section 64 may be vertically displaceable when placed under load.

FIG. 9 illustrates the main frame rod 58 mounted to the seat panel 53. The main frame rod 58 is connected to this panel 53 by engaging the front seat connectors 55 with the front transverse rod section 59. The rear seat portion 20 is joined to the connecting rod section 64 of the suspension arms 62. The rear seat portion 20 is supported on the suspension arms 62, which arms 62 are resiliently deflectable to permit flexing and vertical movement of the rear seat portion 20 to provide comfort to the user. This structure leaves the pivot mount 61 exposed on the sides of the seat panel 53 for subsequent joining to the tension mechanism 25.

Figure 11:
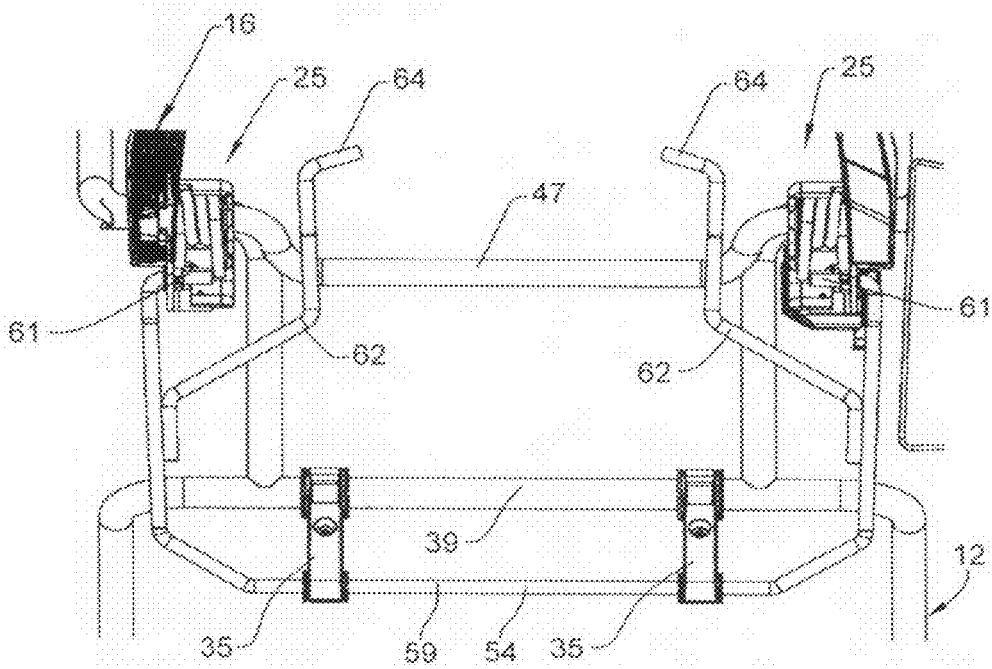
FIG. 11 is a plan view of the assembled chair frame and seat frame with the seat panel omitted therefrom.

In this regard, FIG. 11 illustrates the main seat frame 54 joined to the chair frame 12 by the front pivot links 35 and the tension mechanisms 25. More particularly, the transverse rod section 59 of the seat frame 54 extends generally parallel to the frame cross tube 39 but forwardly and upwardly spaced therefrom. The two front links 35 are laterally spaced apart and extend forwardly and upwardly at an inclined angle relative to a horizontal reference plane to effectively join to the cross tube 39 at pivot point P3 and to the transverse rod section 59 at pivot point P2. As such, the front links 35 are pivotal upwardly in response to rearward tilting displacement of the seat assembly 15.

Figure 12:
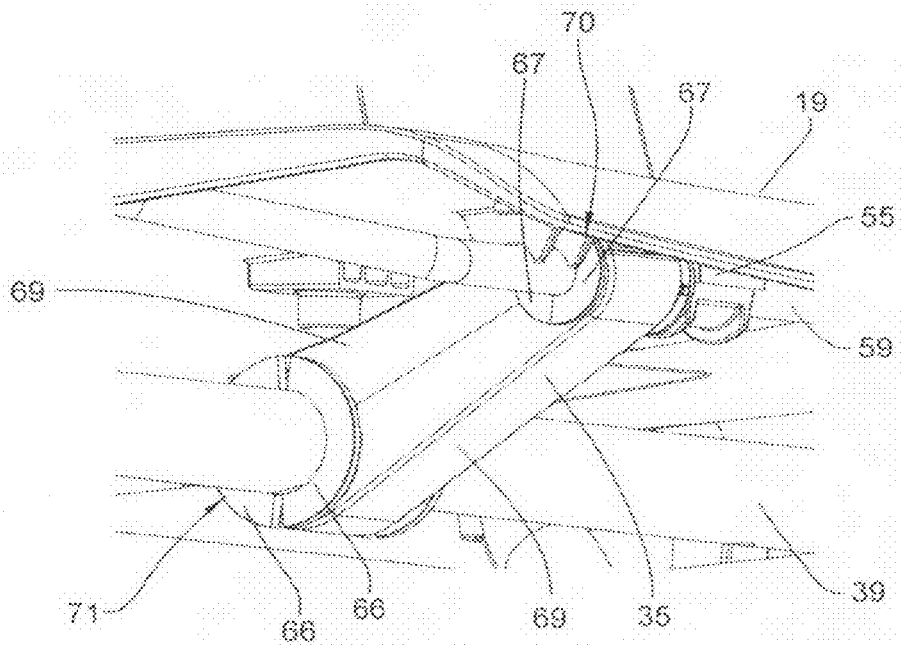
FIG. 12 is an enlarged right front corner view of the chair.
Figure 13:
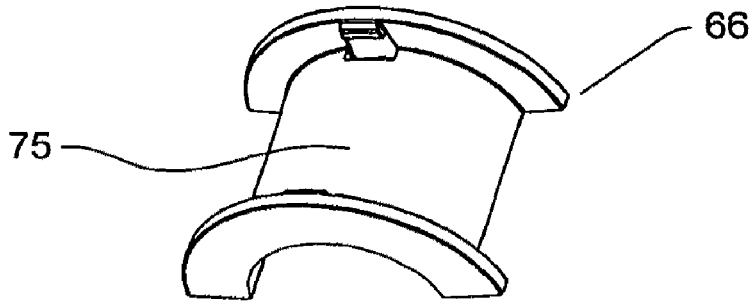
FIG. 13 is an enlarged view of one-half of a bearing collar.
Figure 14:
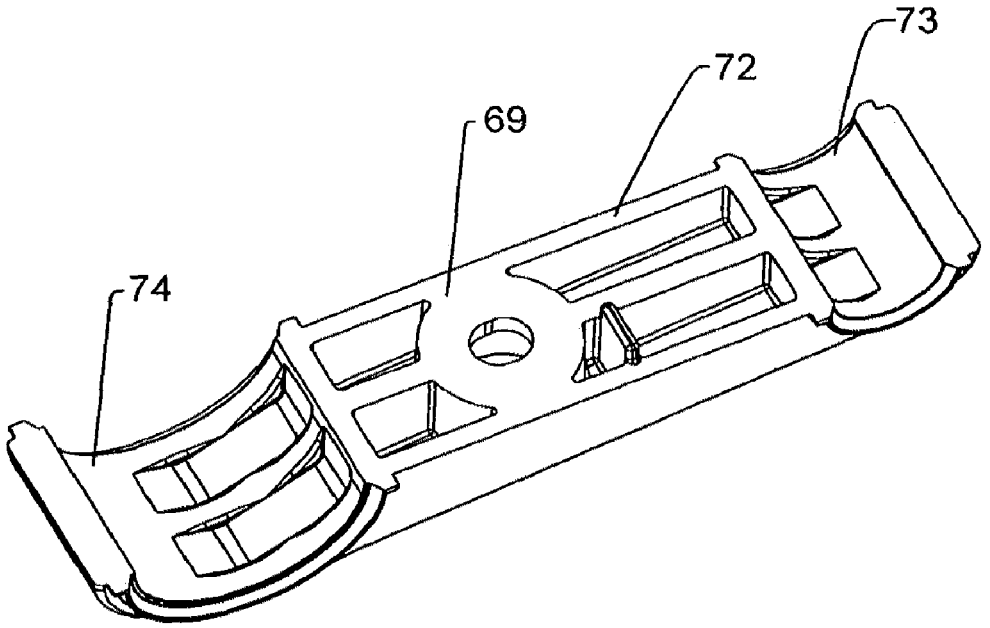
FIG. 14 is a perspective view of one-half of a front seat link.

More particularly as to the front links 35, the front links are formed of semi-circular bearing sections or collars 66 (FIGS. 12 and 13) which are formed as half-circles with a pair of such bearing sections 66 being mated together to encircle the cross tube 39. A smaller pair of bearing sections or collars 67 are positioned to snap together and wrap about the transverse rod section 59. The front link 35 is defined by an opposed pair of link brackets 69 which are configured to be positioned in opposing relation, and encircle the upper and lower bearings 70 and 71 to pivotally engage each of the tube 39 and rod 59.

More particularly, the link bracket 69 comprises a central body 72 which defines a small bearing seat 73 and the larger bearing seat 74 at its opposite ends, wherein the bearing seat 74 mates with the outer channel 75 of the bearing section 66 and is able to rotate relative thereto during pivoting of the link 35. The front bearing seat 73 similar seats with an outer channel of the bearing section 67 and is relatively rotatable to provide a low friction pivot connection therebetween.

As to the suspension arms 62, these project rearwardly and are located above the rearwardly-disposed central tube section 47 to provide a vertical clearance that permits the flexing movement of the rear seat section 20.

Figure 15:
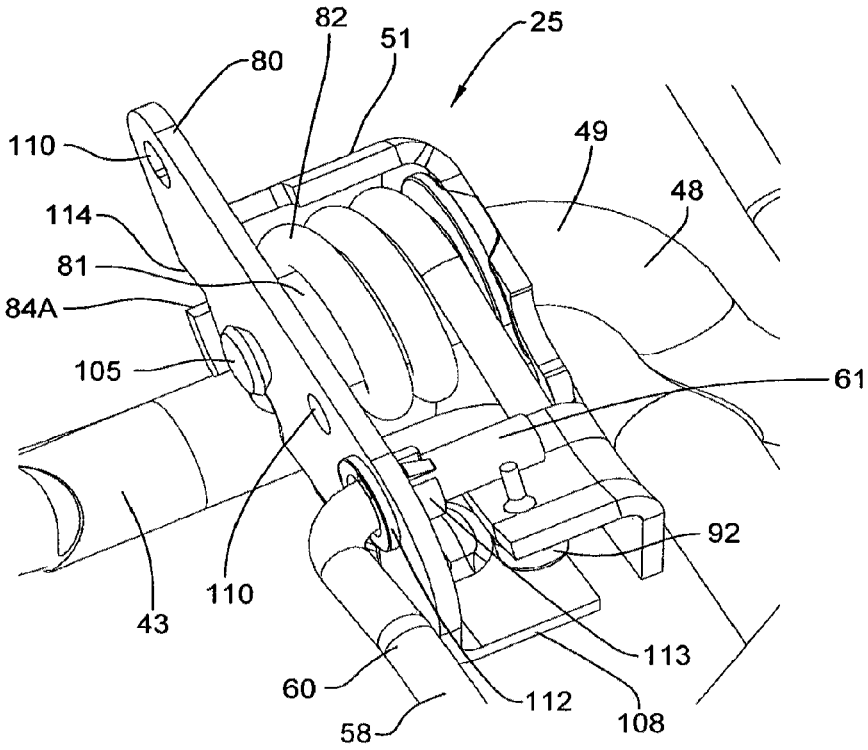
FIG. 15 is an assembly view of the assembled tension mechanism including a coil spring, pivot arm or plate and seat frame connected thereto.
Figure 16:
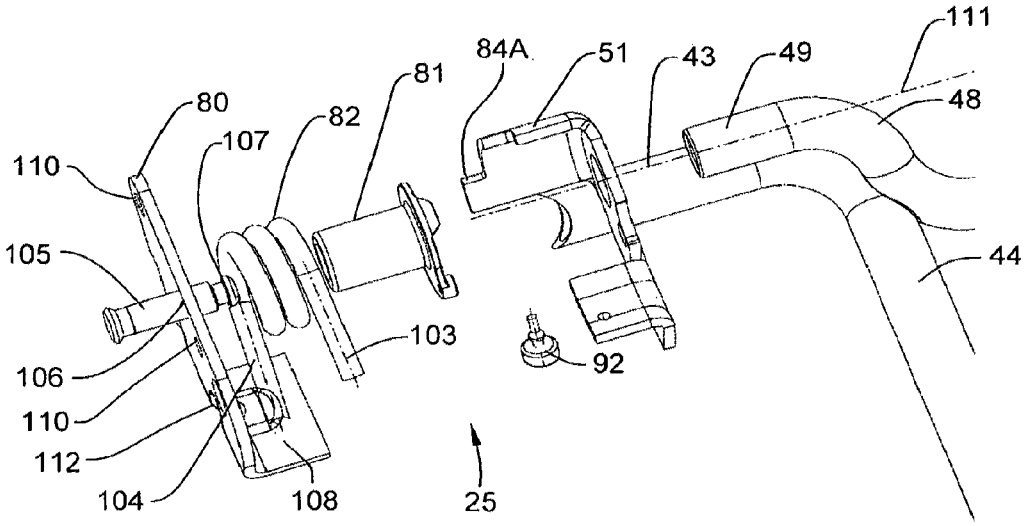
FIG. 16 is an exploded view of the tension mechanism.

The pivot mounts 61 further connect to the tension mechanism 25 at the pivot point P1 so that the pivot mounts 61 move upwardly and downwardly in response to rearward tilting of the back assembly 16. Referring to FIGS. 15 and 16, the tension mechanism 25 is illustrated in further detail. As previously mentioned, the tension mechanism comprises the stationary support plate 51, and also includes a pivot plate 80 which is pivotally connected or supported on the mounting post 49 of the chair frame 12. The specific components of the tension mechanism 25 are described further herein. However, it will be understood that the pivot plate 80 is connected to upright member 29 so as to define the link L1.

Additionally, a cup-like bearing 81 is provided which mounts on the mounting post 49 and supports a coil spring 82 thereon. The coil spring 82 acts between the stationary plate 51 and the pivot plate 80 to generate the resilient restoring force acting upon the back assembly 16.

Figure 17:
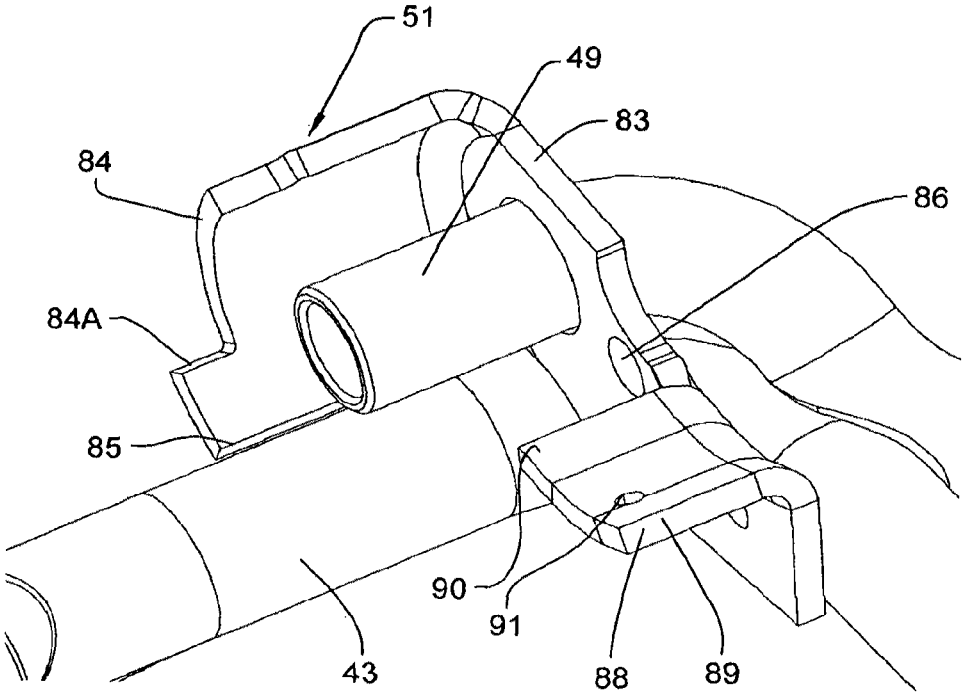
FIG. 17 is an enlarged rear corner view of a support bracket mounted to the chair base frame.
Figure 18:
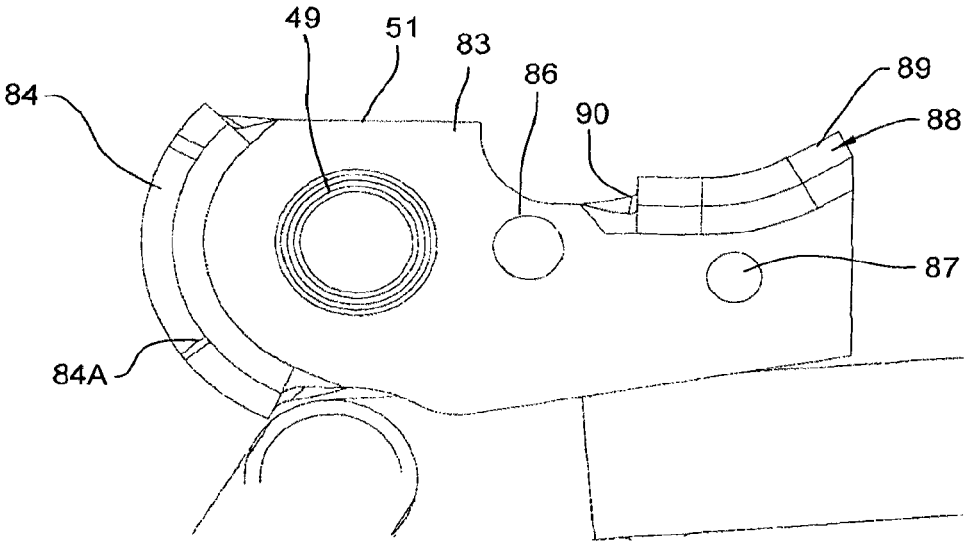
FIG. 18 is a side view thereof.

Referring more particularly to FIGS. 17 and 18, the stationary support bracket 51 is fixedly secured to the mounting post 49. In this regard, the support bracket 51 comprises a side wall 83 having a relatively large hole through which the mounting post 49 projects sidewardly. The circumferential edge of this hole is welded directly to the mounting post 49. Additionally, the bracket 51 has an end wall 84 having an arcuate shape and a bottom edge 85 which is welded to the transverse tube extension 43.

Also, the side wall 83 includes a first hole 86 and a second hole 87 along with a stop flange against which the coil spring 82 acts. This stop flange 88 projects sidewardly and has a front edge 89, a rear edge 90 and a vertical hole 91 extending therethrough.

A side edge of the end wall 84 also includes an arcuate notch terminating at a notch edge 84A.

As to the assembly of the tension mechanism 25, a bumper 92 is provided which has an elastomeric head 93 and a mounting pin 94 that fits through the aforementioned hole 91 in compressive, frictional engagement therewith. The bumper 92 serves as a soft stop to dampen the recline of the back since the bumper 92 is positioned to stop pivoting of the pivot plate 80 as described in further detail below relative to FIG. 22.

Figure 19:
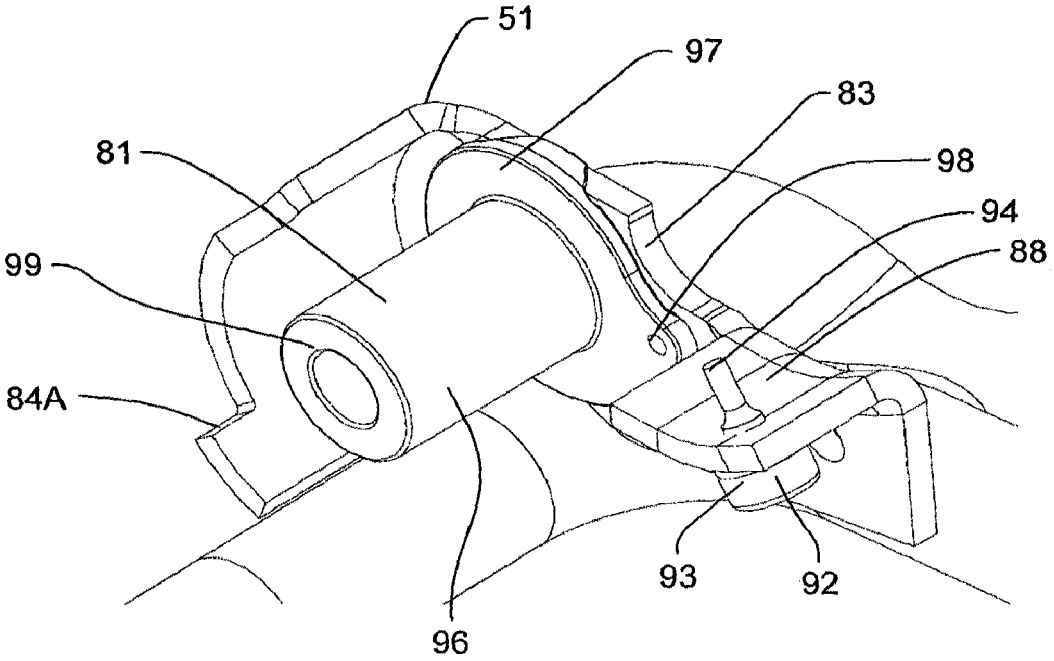
FIG. 19 is a partially assembled view of the tension mechanism.
Figure 20:
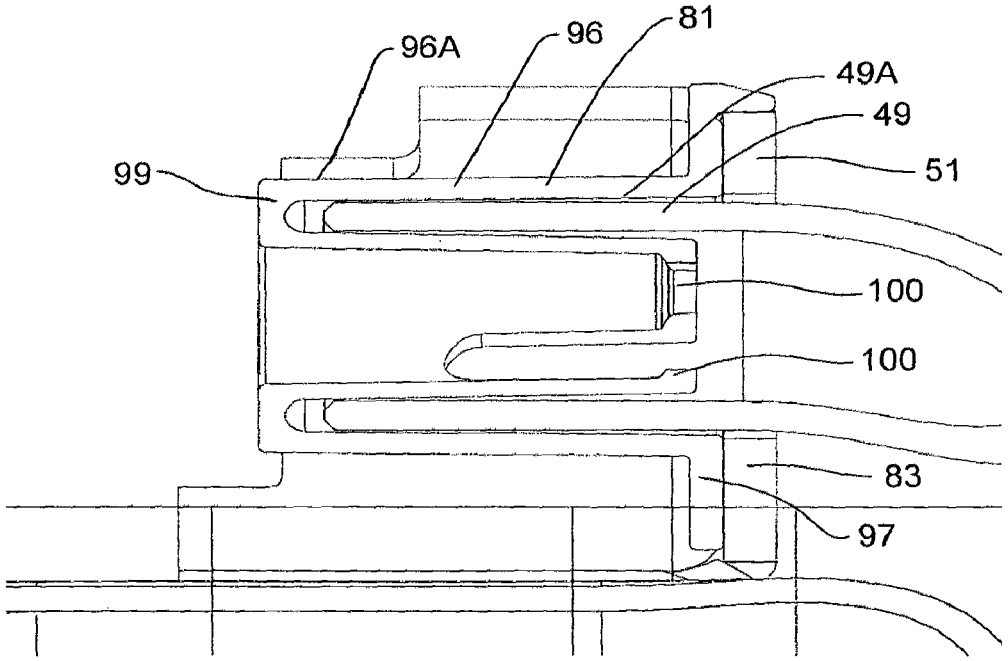
FIG. 20 is a front cross-sectional view of the support bracket with a cup-shaped support bearing.

As to FIGS. 19 and 20, the bearing 81 is installed in position on the mounting post 49. In particular, the bearing 81 has a cylindrical shape defined by an outer bearing wall 96 which is sized to fit closely over the outer circumferential surface 49A of the mounting post 49. This bearing wall 96 has a circumferential collar 97 which abuts against the opposing face of the stationary plate 51. The collar 97 has a radial extension extending forwardly which includes a fastener hole 98 through which a fastener is threadedly engaged with the corresponding hole 86 in the bracket side wall 83. This fixedly secures the bearing 81 in position.

The bearing wall 96 also includes an end wall 99 which projects radially inwardly near the free end of the mounting post 49. The end wall 99 turns radially inwardly and then again turns axially to define separated connector fingers 100 which extend axially but are circumferentially separated from each other.

Figure 21:
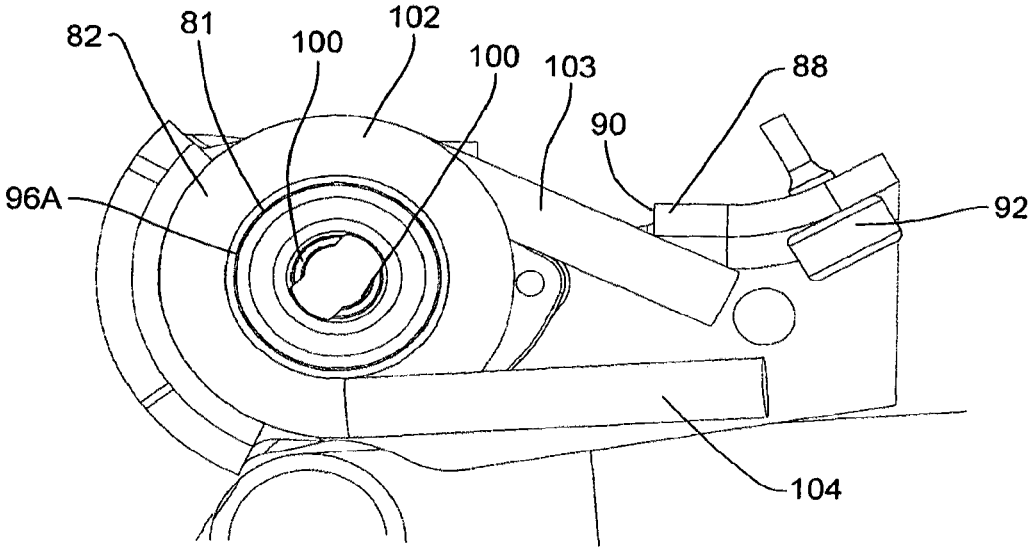
FIG. 21 is a side view thereof with the pivot plate removed therefrom.
Figure 22:
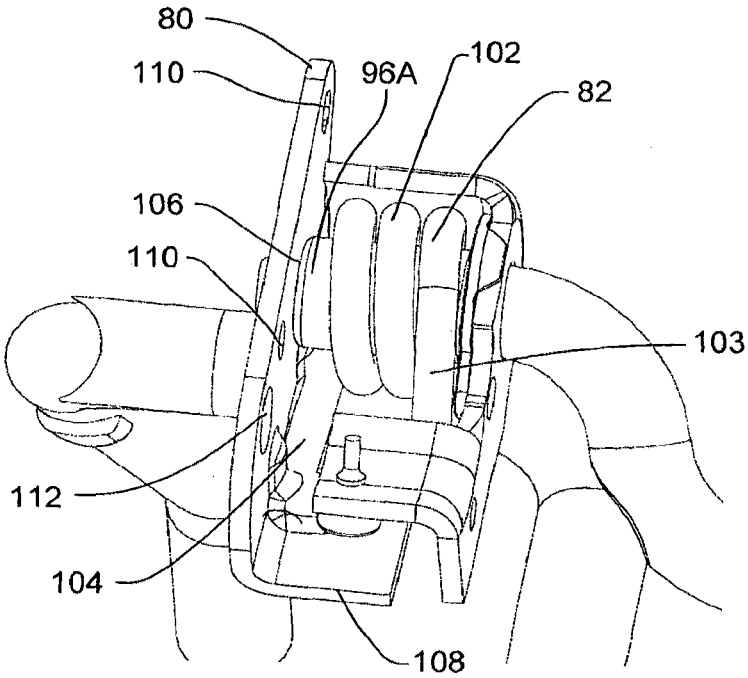
FIG. 22 is a front perspective view of the assembled tension mechanism.

Next as to FIGS. 21 and 22, the coil spring or biasing member 82 is slid onto a free end of the bearing 81 so that the circumferential coils 102 extend about the outer surface 96A of the bearing wall 96. The spring 82 further includes a stationary spring leg or biasing part 103 which abuts underneath the flange 88 proximate the rear edge 90 thereof. During pivoting of the back assembly, this spring leg 103 remains stationary since it is essentially affixed to the chair frame 12. A second movable spring leg or biasing part 104 is provided which extends forwardly and cooperates with and therefore is deflected by the movable pivot plate 80. During this pivoting, the spring leg 104 is pivoted upwardly by rotation of the pivot plate 80 as will be further described hereinafter.

Figure 23:
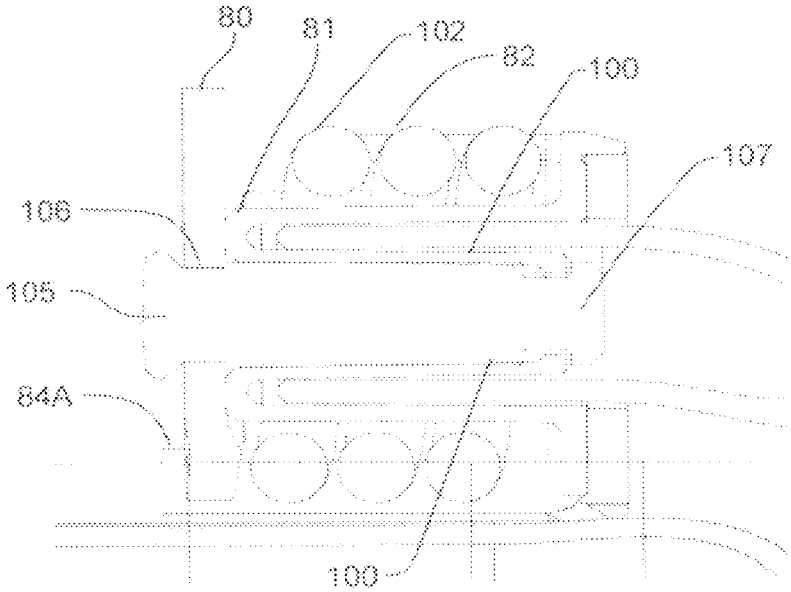
FIG. 23 is a front cross-sectional view of the fully assembled tension mechanism.

When the coil spring 82 is slid onto the bearing 81, the pivot plate 80 is then mounted to the pivot bearing 81 by a connector pin 105. Referring to FIGS. 22 and 23, the pivot plate 80 includes a hole 106 through which the pin 105 is frictionally engaged. As such, the pin 105 projects sidewardly from the plate 80 and is configured to be inserted into the hollow interior of the bearing 81. The innermost end of the pin 105 includes a connector head 107 which is enlarged relative to a narrow diameter section or groove immediately adjacent thereto. This connector head 107 is adapted to move past or snap past the bearing connector fingers 100 so that ribs on the free ends of the fingers 100 snap into the reduced diameter section of the pin 105 as seen in FIG. 23. In this manner, the pivot plate is rotatably connected to the bearing 81 by snapping the connector pin 105 therein. The plate 80 and its inner-connected pin 105 are able to rotate relative to the bearing 81 which thereby causes flexing of the spring leg 104. In this regard, the plate 80 (FIG. 22) includes a sidewardly projecting flange 108 against which the spring leg 104 abuts downwardly. During rearward tilting of the back assembly, this plate 108 thereby is displaced upwardly in unison with the back which thereby causes the spring leg 104 to move upwardly closer to the top spring leg 103 which generates a resilient deflection of the spring 82 and effects a resilient restoring or biasing force which acts back downwardly against the flange 108.

In this manner, the tension mechanism 25 can be assembled as a cartridge-like assembly which is easily assembled together and held in position for final assembly of the components.

More particularly, the pivot plate 80 additionally includes two fastener holes 110 which align with the respective fastener bores 33 that are provided in the mounting leg 31 (FIG. 6) of the upright member 29 that is being mounted to such plate 80. Fasteners are appropriately engaged through these holes 110 and the bores 33 to secure each upright member 29 to each respective pivot plate 80. In this manner, the back assembly 16 is now joined to the chair frame 12 so as to pivot about the axis that extends through the connector pin 105. This axis is illustrated in FIG. 16 and identified by reference arrow 111 and further corresponds to the pivot axis P0 referenced above as to FIG. 5.

Figure 24:
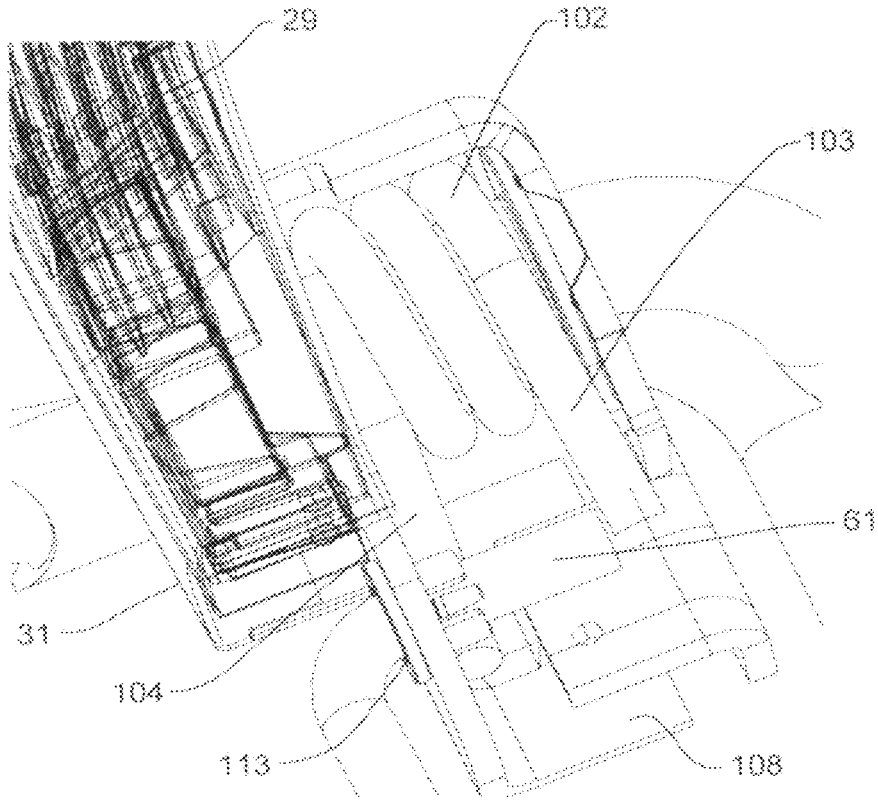
FIG. 24 illustrates the rear upright mounted thereto.

The pivot plate further connects to the seat frame 58 through the pivot mounts 61 of the side rod sections 60. To effect such connection, the pivot plate 80 also includes an additional pivot bore 112 (FIGS. 15 and 22). This bore 112 receives a plastic bearing 113 which is snapped therein and has a central bore through which the rod-like pivot mount 61 extends sidewardly as illustrated in further detail in FIGS. 11, 15 and 24. This thereby defines the pivot point P1 (FIG. 5).

Therefore, during rearward tilting of the back assembly 16, pivot plate 80 will rotate and lift the flange 108. To limit or define a stop for rearward tilting, the flange 108 is also adapted to strike the bumper 92 to define a soft stop. Additionally, it is noted from FIGS. 15 and 23 that the pivot plate 80 essentially fits in the notched portion of the bracket end wall 84 and has a bottom edge 114 that is disposed in interfering relation with the notch edge 84A which would also provide a hard stop if necessary to stop rearward tilting.

Since the pivot plate 80 is affixed to the upright mounting leg 31, the extent of the plate 80 which projects forwardly from the aforementioned pivot axis 111 defines the link L1. As this bracket 80 pivots upwardly, the interconnection of the bracket 80 to the seat frame mount 61 causes the mount 61 and the associated seat to displace upwardly in the direction of reference arrow 21 (FIG. 2). This effects the lifting movement of the rear seat portion 20 which then is subject to the weight of the occupant so that the weight of the occupant resists the pivoting of the plate 80 and the rearward tilting of the back assembly 16.

The spring mechanisms 25 thereby provide a readily mountable tension mechanism which facilitates assembly and construction of the chair 10. Further, the improved suspension arrangement of the seat assembly allows for additional flexing of the rear seat portion 20 due to the deflectability of the suspension arm 62 while the frame mounts 61 still remain relatively fixed and stationary since they are rigidly connected to the tension mechanism 25. This allows additional flexure of the rear seat portion 20 without requiring any displacing movement of the seat mounts 61.

Although particular preferred embodiments of the invention have been disclosed in detail for illustrative purposes, it will be recognized that variations or modifications of the disclosed apparatus, including the rearrangement of parts, lie within the scope of the present invention.

What is claimed is:

1. A weight-responsive chair comprising:

a chair frame;

a seat pivotally supported on said chair frame at a front portion by a front pivot link; and having a rear portion overlying said chair frame;

a back comprising a back upright pivotally connected to said chair frame at pivot points on opposite sides of the chair frame and having a connector link that extends forwardly from each said pivot point of said back which connects to said rear portion of the seat, a combination of the front pivot link, the chair frame, the seat and the connector links of the back upright defining a four-bar linkage wherein rearward tilting of the back upright effects lifting of the rear portion of the seat and causes the connector links to pivot upwardly and thereby lift the seat against the weight of the user; and a tension mechanism connected between the chair frame and the back upright to provide a relatively low level of resistance to tilting of the back upright, said tension mechanism including a biasing arrangement which serves to restore the seat and back to an upright position, said chair frame including sidewardly directed mounting posts adjacent said pivot points and a stationary plate, and said tension mechanism further including a sub-assembly mounted to each said mounting post, said sub-assembly comprising a rotation bearing as well as a biasing spring and a rotatable plate which are supported on said bearing, which bearing in turn mounts to said mounting posts so that said spring cooperates with said stationary and rotatable plates and said rotatable plate is rotatable about an axis of said bearing, said rotatable plate being connected to said back upright so as to rotate therewith and generate said low level of resistance to tilting.

2. The chair according to claim 1, wherein said seat includes a seat frame connected to said front pivot link and said connector links wherein said seat frame includes resiliently deflectable suspension arms which interconnect to a central portion of the rear portion of the seat, said suspension arms allowing for resilient vertical displacement of the rear portion of the seat relative to and independent of the combination such that the combination effects lifting of the rear portion of the seat while the suspension arms also permit independent resilient movement of the rear portion to improve comfort to the user.

3. The chair according to claim 1, wherein said spring is a coil spring having a first spring leg cooperating with said stationary plate and a second spring leg cooperating with said rotatable plate.

4. The chair according to claim 3, wherein said seat has a seat frame supported on said rotatable plate.

5. The chair according to claim 3, wherein said bearing is fixed to said stationary plate by a fastener.

6. The chair according to claim 3, wherein said rotatable plate is fixed to said bearing by a connector pin.

7. The chair according to claim 6, wherein said bearing includes snap connectors which snap fittingly engage an end of said connector pin.

8. The chair according to claim 7, wherein said rotatable plate is fixed to said back by fasteners engaged therebetween.

9. A weight-responsive chair comprising:

a chair frame;

a seat pivotally supported on said chair frame at a front portion by a front pivot link and having a rear portion overlying said chair frame;

a back comprising a back upright pivotally connected to said chair frame at pivot points on opposite sides of the chair frame and having a connector link that extends forwardly from each said pivot point of said back which connects to said rear portion of the seat, a combination of the front pivot link, the chair frame, the seat and the connector links of the back upright defining a four-bar linkage wherein rearward tilting of the back upright effects lifting of the rear portion of the seat and causes the connector links to pivot upwardly and thereby lift the seat against the weight of the user; and a tension mechanism connected between the chair frame and the back upright to provide a relatively low level of resistance to tilting of the back upright, said tension mechanism including a biasing arrangement which serves to restore the seat and back to an upright position, said chair frame including sidewardly directed mounting posts adjacent said pivot points and a stationary plate, and said tension mechanism further including a sub-assembly mounted to each said mounting post, said sub-assembly comprising a rotation bearing as well as a biasing spring and a rotatable plate which are supported on said bearing, which bearing in turn mounts to said mounting posts so that said spring cooperates with said stationary and rotatable plates and said rotatable plate is rotatable about an axis of said bearing, said rotatable plate being connected to said back upright so as to rotate therewith and generate said low level of resistance to tilting, said rotatable plate being fixed to said bearing by a connector pin wherein said bearing includes snap connectors which snap fittingly engage an end of said connector pin, and said rotatable plate in turn being fixed to said back by fasteners engaged therebetween.

10. The chair according to claim 9, wherein said spring is a coil spring having a first spring leg cooperating with said stationary plate and a second spring leg cooperating with said rotatable plate.

11. The chair according to claim 10, wherein said seat has a seat frame supported on said rotatable plate.

12. The chair according to claim 11, wherein said bearing is fixed to said stationary plate by a fastener.

13. The chair according to claim 12, wherein said seat includes a seat frame connected to said front pivot link and said connector links and said seat frame includes resiliently deflectable suspension arms which interconnect to a central portion of the rear portion of the seat, said suspension arms allowing for resilient vertical displacement of the rear portion of the seat relative to and independent of the combination such that the combination effects lifting of the rear portion of the seat while the suspension arms also permit independent resilient movement of the rear portion to improve comfort to the user.

14. The chair according to claim 9, wherein said chair frame is formed from tubes having a circular profile, said tubes having free ends which project sidewardly to define said mounting posts.

15. A weight-responsive chair comprising:

a chair frame;

a seat having a seat frame pivotally supported on said chair frame at a front portion of said seat by a front pivot link and having a rear portion of said seat overlying said chair frame;

a back comprising a back upright pivotally connected to said chair frame at a pivot point and having a connector link that extends forwardly from said pivot point of said back which connects to said rear portion of the seat, a combination of the front link, the chair frame, the seat and the connector link of the back upright defining a weight-responsive mechanism, wherein rearward tilting of the back upright effects lifting of the rear portion of the seat and causes the connector link to pivot upwardly and thereby lift the seat against the weight of the user; and a tension mechanism connected between the chair frame and the back upright to provide a relatively low level of resistance to tilting of the back upright, said tension mechanism including a biasing arrangement which serves to restore the seat and back to an upright position; and said seat frame further including resiliently deflectable suspension arms which interconnect to a central portion of the rear portion of the seat, said suspension arms allowing for resilient vertical displacement of the rear portion of the seat independent of the weight-responsive mechanism such that the weight-responsive mechanism effects lifting of the rear portion of the seat while the suspension arms also permit simultaneous independent resilient movement of the rear portion to allow the rear portion of the seat to lower to improve comfort to the user.

16. A weight-responsive chair comprising:

a chair frame;

a seat having a seat frame pivotally supported on said chair frame at a front portion of said seat by a front pivot link and having a rear portion of said seat overlying said chair frame;

a back comprising a back upright pivotally connected to said chair frame at a pivot point and having a connector link that extends forwardly from said pivot point of said back which connects to said rear portion of the seat, a combination of the front link, the chair frame, the seat and the connector link of the back upright defining a four-bar linkage and a weight-responsive mechanism, wherein rearward tilting of the back upright effects lifting of the rear portion of the seat and causes the connector link to pivot upwardly and thereby lift the seat against the weight of the user; and a tension mechanism connected between the chair frame and the back upright to provide a relatively low level of resistance to tilting of the back upright, said tension mechanism including a biasing arrangement which serves to restore the seat and back to an upright position;

said seat frame further including resiliently deflectable suspension arms which interconnect to a central portion of the rear portion of the seat, said suspension arms allowing for resilient vertical displacement of the rear portion of the seat independent of the weight-responsive mechanism such that the weight-responsive mechanism effects lifting of the rear portion of the seat while the suspension arms also permit independent resilient movement of the rear portion to improve comfort to the user; and wherein said seat frame has a U-shaped main section defined by rearwardly-projecting legs which terminate at free ends that pivotally connect to said tension mechanism, said seat frame further including said suspension arms which support said seat to allow for independent vertical movement of the rear portion of said seat relative to said tension mechanism.

17. The chair according to claim 16, wherein said seat comprises a horizontally-enlarged panel which mounts on said seat frame.

18. The chair according to claim 16, wherein said front pivot link is pivotally connected to said main section at a front of said seat.

19. The chair according to claim 18, wherein said front pivot link is defined by two pivot halves which capture said main section therebetween.

20. The chair according to claim 19, wherein said seat frame has a tubular front frame section extending crosswise, and said two pivot halves capture said front frame section therebetween.

* * * * *

UNITED STATES PATENT AND TRADEMARK OFFICE

CERTIFICATE OF CORRECTION

PATENT NO. : 8,272,693 B2
APPLICATION NO. : 12/925889
DATED : September 25, 2012
INVENTOR(S) : Jason Hall et al.

It is certified that error appears in the above-identified patent and that said Letters Patent is hereby corrected as shown below:

Column 9, line 37 please delete “;”.

Signed and Sealed this
Fourth Day of December, 2012

David J. Kappos

David J. Kappos
*Director of the United States Patent and Trademark Office*